United States Patent [19]

Mills

[11] Patent Number: 4,996,941

[45] Date of Patent: Mar. 5, 1991

[54] GYPSUM WALLBOARD TAPING SYSTEM

[76] Inventor: Gregory B. Mills, 3410 W. MacArthur Blvd. Ste. "A", Santa Ana, Calif. 92704

[21] Appl. No.: 320,272

[22] Filed: Mar. 7, 1989

[51] Int. Cl.[5] ..... B05C 3/12; B44C 7/00

[52] U.S. Cl. ..... 118/419; 118/423; 156/527; 156/575; 156/577; 156/578; 156/579

[58] Field of Search ..... 156/527, 574, 578, 579, 156/575, 524–526, 530–534; 118/122, 123, 423, 424, 419, DIG. 17; 242/84.8; 220/4 A, 4 D, 4 C

[56] References Cited

U.S. PATENT DOCUMENTS

| | | | |
|---|---|---|---|
| 387,541 | 8/1888 | Roe | 242/84.8 |
| 591,747 | 10/1897 | Eddy | 242/84.8 |
| 2,741,220 | 4/1956 | Belisle | 156/526 |
| 2,873,881 | 2/1959 | Nichols | 220/4 A |
| 3,112,225 | 11/1963 | Harms | 156/527 |
| 3,309,000 | 3/1967 | Haverstick | 220/4 A |
| 3,344,770 | 10/1967 | Schaefer | 118/428 |
| 4,202,288 | 5/1980 | Davy, Jr. | 118/424 |
| 4,689,107 | 8/1987 | Entwistle | 156/531 |
| 4,758,291 | 7/1988 | Fechner | 156/575 |

*Primary Examiner*—Michael W. Ball
*Assistant Examiner*—Chester T. Barry
*Attorney, Agent, or Firm*—Morland C. Fischer

[57] ABSTRACT

A labor saving taping system for use during the installation of gypsum wallboard, whereby the seam between a pair of adjacent drywall panels can be easily and reliably taped with paper drywall tape that has been precoated with wet adhesive mud. This system comprises the detachable interconnection of a frame and a mud reservoir. The drywall tape is fed from a supply roll and threaded along the frame for total emersion in the reservoir so as to receive a coating of mud on both sides thereof. The system also includes a taping tool comprising a hollow housing and a shaft around which the mud-coated drywall tape can be wound for storage and later use.

12 Claims, 8 Drawing Sheets

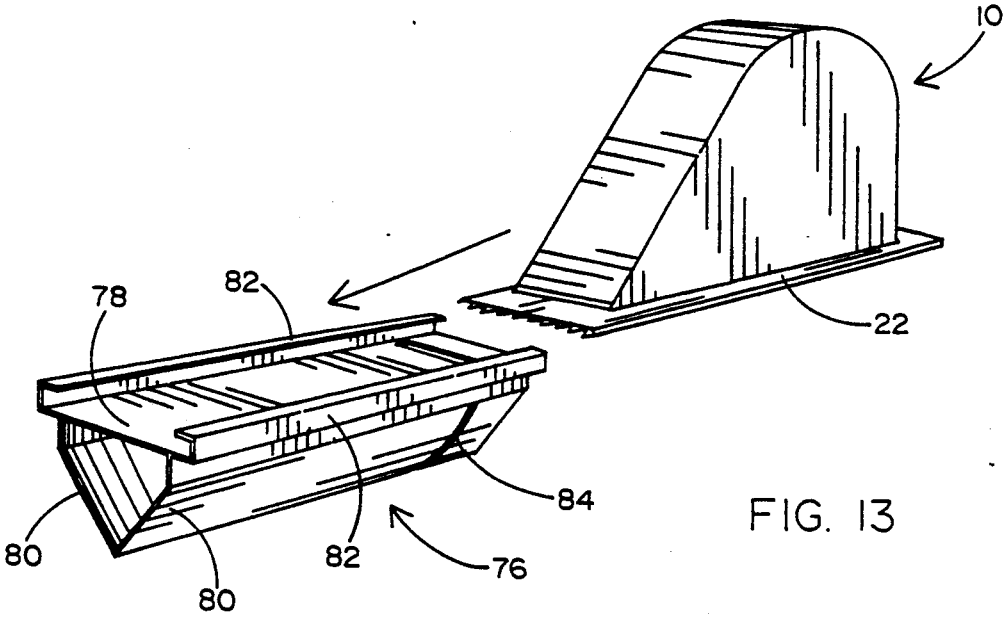
FIG. 13
FIG. 14
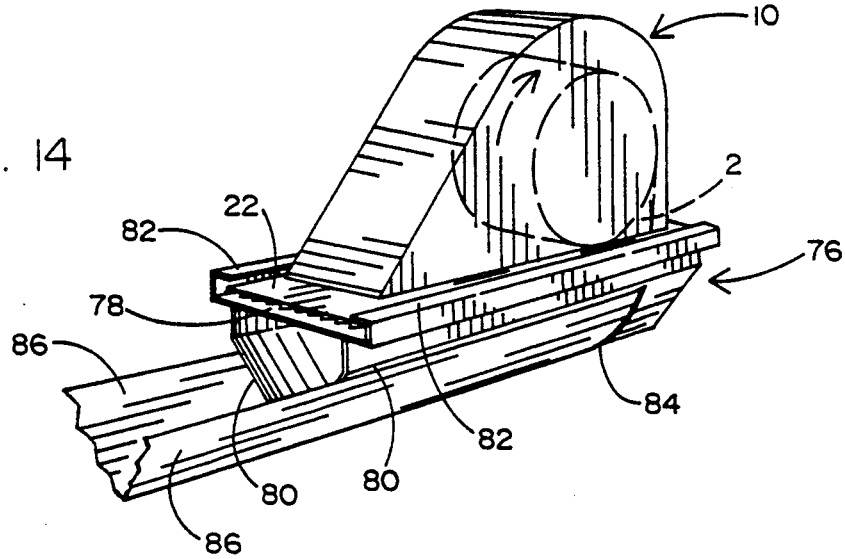
FIG. 15
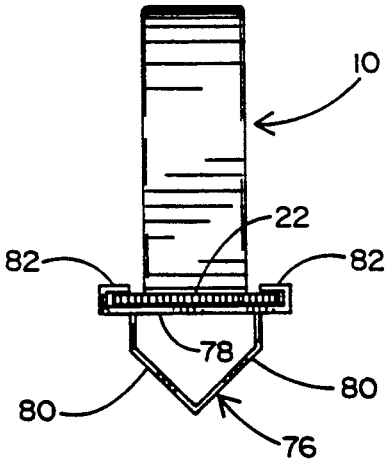

GYPSUM WALLBOARD TAPING SYSTEM

BACKGROUND OF THE INVENTION

1. FIELD OF THE INVENTION

This invention relates to a simplified, potentially low cost system for applying drywall tape, which has been precoated on both sides thereof with a wet adhesive mud, during the installation of gypsum wallboard.

2. BACKGROUND ART

The repetitive and laborious process of taping drywall has led to several systems of taping, each of which having serious limitations. Since the advent of drywall technology, the taping of the seams that are created when sheets of drywall are nailed in place has been a pedestrian exercise that requires the handling of paper tape and wet adhesive mud. Such paper tape and adhesive mud are presently sold separately, such that the mud is not applied to the paper tape prior to use. In the time consuming manual application of the paper tape, the adhesive mud is manually scooped out of a container and applied with a smearing action to drywall seams with a drywall knife. The paper tape is then unrolled so as to be laid upon the seam and wiped down into the wet mud. The tape is later top coated with more mud and wiped smooth after each coat to flatten the tape surface. In the conventional time consuming, manual taping method just described, one layer of mud is applied under the paper tape to achieve adhesion, and at least two additional layers of mud are commonly applied over the tape to embed the tape within the mud. The top layers of mud are applied and wiped down until the mud appears smooth and the gap between the drywall sheets is made flat. The mud should be allowed to dry between successive coats.

One well known commercial taping system is sometimes known as the Ames system. The Ames system consists of a series of tools that are designed to handle both dry, non-adhesive paper tape and wet adhesive mud to make the tape applying procedure faster than if it were manually completed. The tools of the Ames system generally consist of a manual mud pump, a taping tool, a roller, finishers and a standard drywall knife. Many of the Ames tools are complex, relatively expensive and require extensive training, adjustment and manual dexterity to operate. In the Ames system, the drywall mud is pumped out of a bucket into a cylinder within the Ames taping tool. This taping tool holds a roll of dry paper tape. When the cylinder of the taping tool is full of mud, the taping tool is held against the seam to be taped and the head of the taping tool is rolled along the seam. The taping tool cylinder is emptied of the mud as a wheel on the taping tool head, which contains a pulley, reels up a steel cable that is attached to a piston within the cylinder. The mud then exits the taping tool through a hole at the head as dry paper tape is rolled onto the mud as it is ejected on the wall. The seam must be wiped down with a drywall knife to complete the taping operation. The seam then requires a top coat of mud to fully embed the tape. With the Ames system, full embedding occurs only after three operations: applying tape and mud to the drywall seam; wiping the tape down; and then top coating the seam.

The aforementioned tool shave various limitations and shortcomings. The Ames system is very expensive and requires many unique parts which must be machined and maintained in proper adjustment. The taping tool is heavy and difficult to use, and requires that many precision parts operate in the hostile environment of gritty adhesive viscous drywall mud. The tool must be cleaned, oiled and adjusted often so as not to break down or become jammed or stop working. Parts have been known to wear out and break, thereby requiring substantial maintenance and expense. Moreover, the Ames taping tool system does not apply mud to the top side of the drywall tape.

A more primitive taping tool called a "banjo" utilizes a reel of dry tape that is threaded through a chamber of wet mud as the tape exits the tool. The muddy tape is then applied directly to the drywall seam and wiped down manually. Since the banjo concentrates all of the mud under the tape, very little mud is applied to the back side of the tape. With a banjo taping system, another coat of mud must be applied to fully embed the tape. What is more, the banjo is slow and inefficient, inasmuch as the mud may not properly and fully coat the underside of the tape, thereby leaving a dry blister. The banjo is heavy and awkward to use and requires that the muddy tape be wiped down after it is unrolled on the drywall seam. What is more, a banjo will not tape inside corners easily.

It would therefore be desirable to have an effective labor saving drywall taping system that is inexpensive to manufacture, easy to use and light in weight. The system should be able to operate in the hostile environment of the adhesive mud materials and not be adversely affected by the mud drying and/or a failure to thoroughly clean the tools after each use. The system should also utilize materials and procedures that are common to the drywall taping industry. It would be further desirable to reduce the occurrence of air blisters which are occasionally formed under the tape. The system should be able to fully embed the drywall tape during the initial application, thus reducing the number of required steps and eliminate much of the labor associated with conventional taping procedures.

SUMMARY OF THE INVENTION

In general terms, a low cost drywall taping system is disclosed for taping the seam between adjacent drywall panels. The system is easier to use and more efficient than conventional taping systems. The taping system includes a mud filled reservoir, which may be a conventional plastic bucket in which drywall mud is commonly sold, a cylindrical collar, which is detachably connected to the mud reservoir to form a vertical extension thereof, a frame which is supported from and aligned by the collar such that a roll of dry wall tape can be suspended above the reservoir and threaded around the frame, and a reusable taping tool into which the tape can be wound up and stored for later use after such tape is first immersed in the mud of the reservoir and simultaneously coated on both sides.

The taping tool has a hollow housing and a centrally located shaft around which the pre-coated drywall tape is wound. A small hook protrudes from the shaft to catch the leading end of the tape after it is immersed in the mud of the reservoir. A hand crank is located at the outside of the housing to rotate the shaft and cause the pre-coated tape to be wound therearound. The taping tool has a flat base plate which slides along the seam to be taped. The base plate has an opening formed therein through which the pre-coated tape that is stored within the housing may be dispensed. The trailing end of the taping tool includes a serrated cutting edge to permit the tape to be cut at any point.

As an alternative embodiment of the invention, a roll of pre-coated drywall tape may be loaded at the factory within a disposable, one-piece taping tool. Unlike the reusable taping tool, the disposable tool has no hand crank or shaft for winding the tape. The taping tool of this embodiment includes a flat base plate having an exit opening formed therein through which the pre-coated tape is dispensed. A bottom flap is folded over and releasably sealed against the base plate to cover the exit opening with the leading end of the tape being retained between said baseplate and bottom flap.

BRIEF DESCRIPTION OF THE DRAWINGS

FIG. 13 shows the reusable taping tool of FIG. 1 and a removable taping shoe to which the taping tool may be attached so that pre-coated tape can be dispensed from the tool for taping inside corners;

FIG. 14 shows the attachment of the taping tool to the taping shoe of FIG. 13; and FIG. 15 is an end view of the attachment of FIG. 14.

DESCRIPTION OF THE PREFERRED EMBODIMENT

Figure 1:
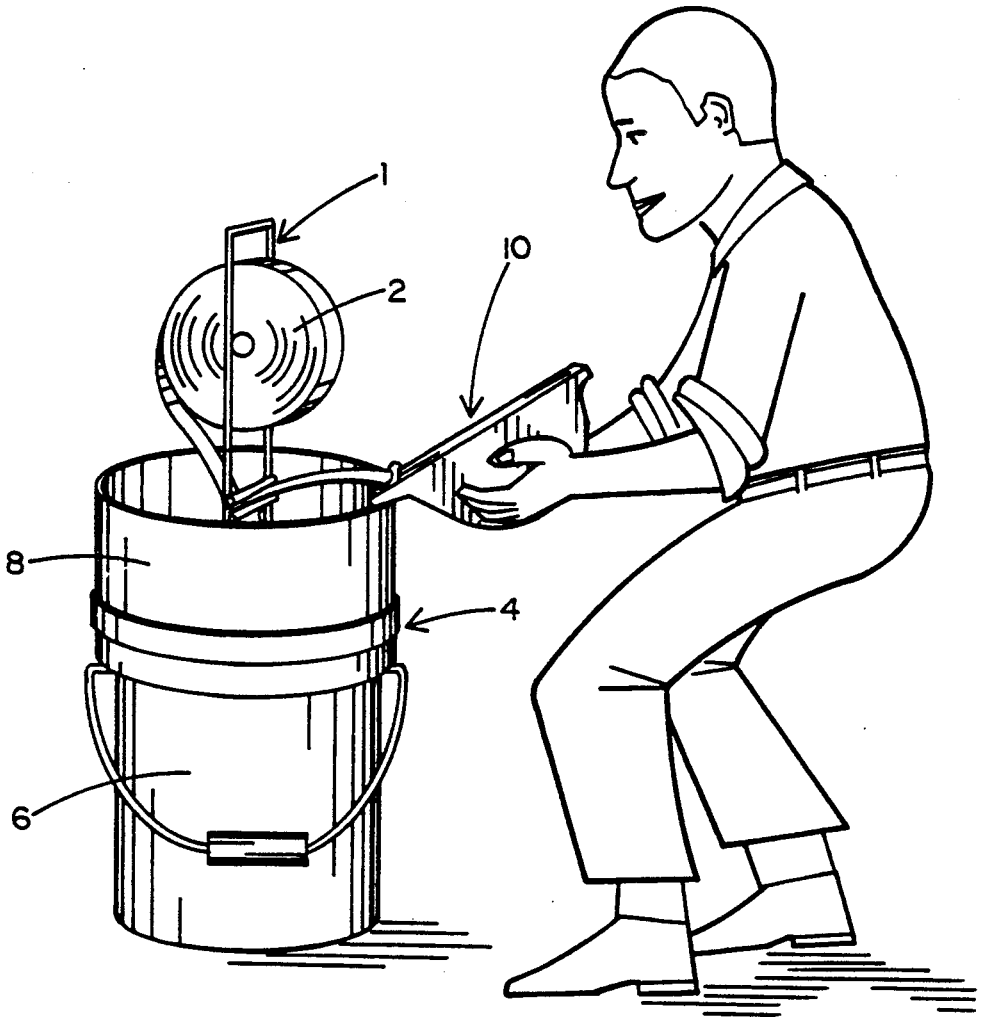
FIG. 1 shows the gypsum wallboard taping system of the present invention with a supply of pre-coated drywall tape being wound into a reusable taping tool.
Figure 8:
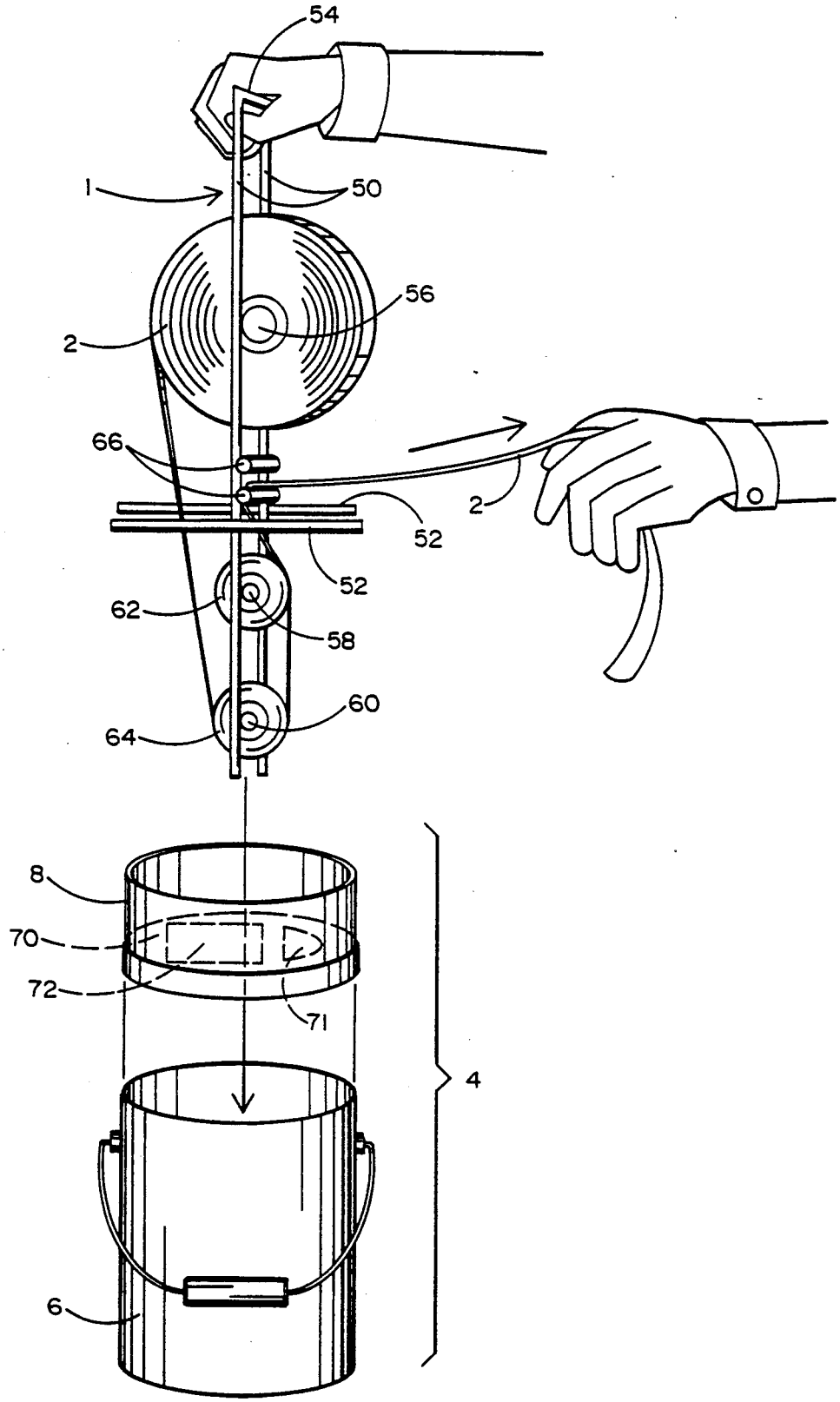
FIG. 8 is an exploded view of the taping system of FIG. 1.

FIG. 1 of the drawings shows the gypsum wallboard taping system which forms the present invention including a frame 1 which carries a roll of paper drywall tape 2 and is removably received within and supported by a mud reservoir 4. Details of the frame 1, by which both sides of the drywall tape can be reliably and efficiently coated with wet adhesive or "mud", will be described in greater detail herein after when referring to FIG. 9. The mud reservoir 4 which supports frame 1 includes a conventional pair or bucket 6, or the like, and a vertical extension or collar 8 which is attached to the pail 6 to support and align the frame 1 (best shows in FIGS. 8 and 9). By virtue of the presently disclosed taping system, a supply of pre-coated drywall tape may be easily rolled up and conveniently stored for later use. To facilitate handling and storage, the system also includes a reusable taping tool 10 (best shown in FIGS. 2–4) within which the pre-coated drywall tape 2 is loaded and from which the tape is dispensed during use.

Figure 2:
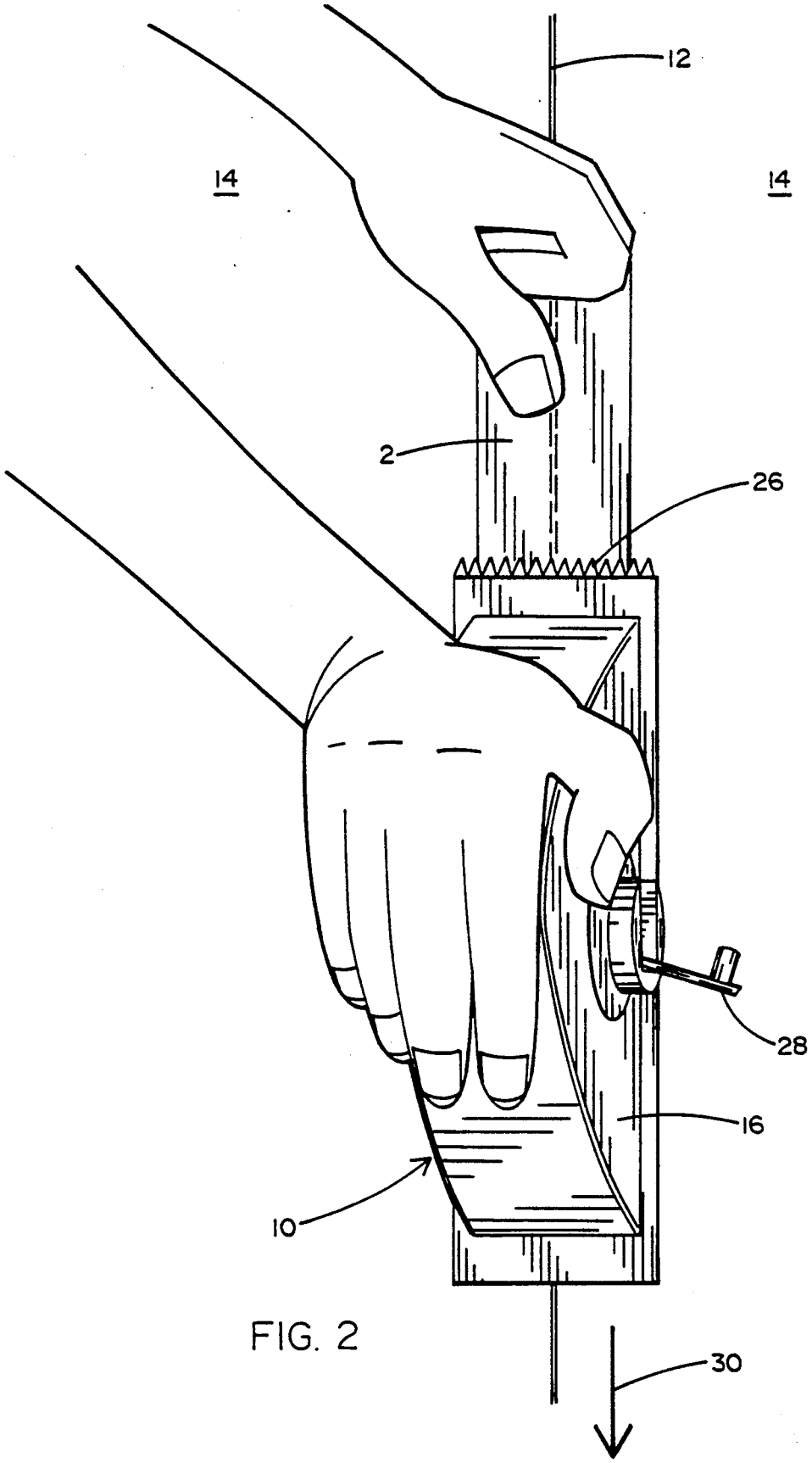
FIG. 2 shows the reusable taping tool of FIG. 1 with pre-coated drywall tape being dispensed therefrom to tape the seam between a pair of drywall panels.
Figure 3:
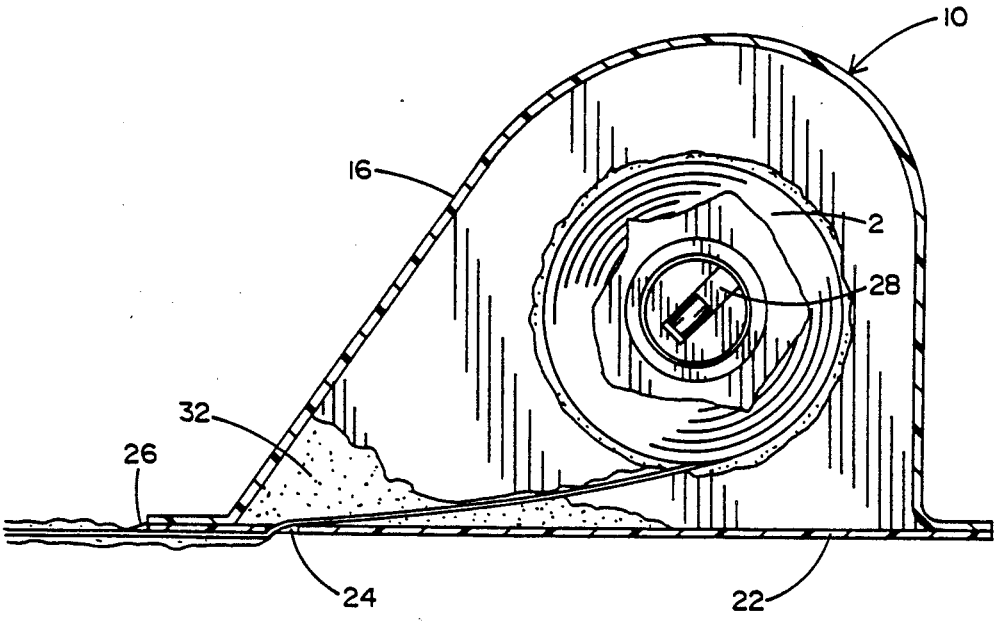
FIG. 3 is a partially broken away side view of the reusable taping tool of FIG. 2.
Figure 4:
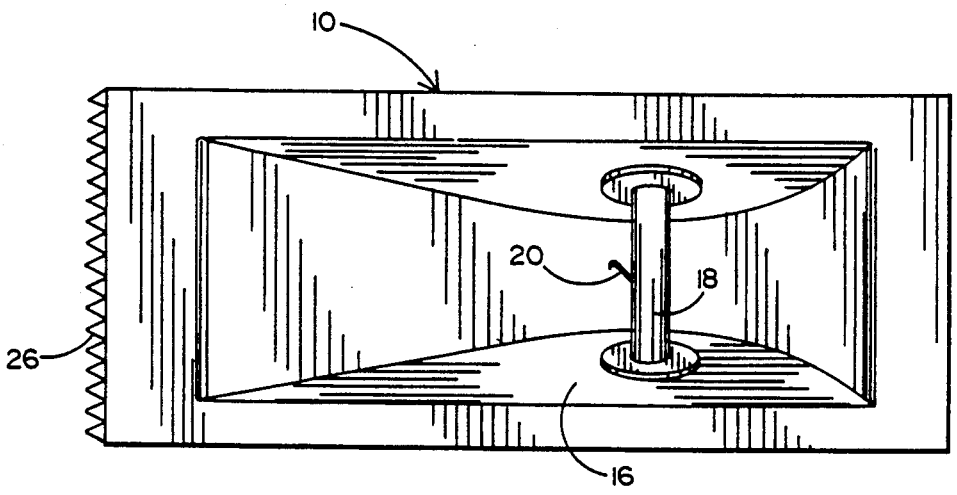
FIG. 4 is a bottom view of the reusable taping tool with its base plate removed therefrom.

FIGS. 2–4 of the drawings show the reusable taping tool 10 of FIG. 1, within which a roll of coated (i.e. premudded) drywall tape 2 is wound, so that a suitable length of such tape can be dispensed therefrom and taped over the seam 12 between a pair of adjacent panels 14 of drywall or gypsum wallboard. Taping tool 10 includes a hollow, arcuate shaped housing 16 into which the pre-coated tape 2 is to be rolled. A shaft or take-up spindle 18 (best shown in FIG. 4) around which the pre-coated tape 2 is wound extends laterally through the housing 16 of taping tool 10. A short hook 20 (also best shown in FIG. 4) projects from the shaft 18 so that the leading end of the mudded tape can be attached to and rolled up on the said shaft within housing 16. One end of the shaft 18 is interconnected with a hand crank 28 at the outside of housing 16. A rotation of hand crank 28 causes a corresponding rotation of the shaft 18 and the winding threrearound of the pre-coated drywall tape 2. A removable baseplate 22 extends across the bottom of the housing 16 of taping tool 10 so that access is available to the hook 20 of shaft 18 at the interior of housing 16. A narrow opening 24 is formed in the baseplate 22 through which the pre-coated tape is wound up or played out. The trailing end of baseplate 22 is provided with a serrated cutting edge 26, whereby the pre-coated drywall tape 2 can be severed at any convenient point therealong.

In operation, the leading end of the pre-coated drywall tape 2 is dispensed from taping tool 10 via the opening 24 in baseplate 22 and held at the seam 12 to be taped (best shown in FIG. 2). The operator then pushes the taping tool 10 (in the direction of reference arrow 30 along the seam 12, such that a supply of pre-coated drywall tape 2 is played out from the housing 16. Any excess mud (designated 32 in FIG. 3), with which the tape 2 is coated, is conveniently scraped from the tape and collected within the housing 16 as the tape emerges from taping tool 10 via opening 24. Accordingly, the taping operation is relatively clean and avoids the build-up of mud deposits on the floor of the work site. After the seam 12 has been adequately taped, the tape 2 is easily cut by means of cutting edge 26. When the supply of tape within the reusable taping tool 10 is exhausted, the baseplate 22 is removed from housing 16 and a new supply of pre-coated tape is attached to hook 20 and rolled up around shaft 18 in a manner like that just described.

Figure 5:
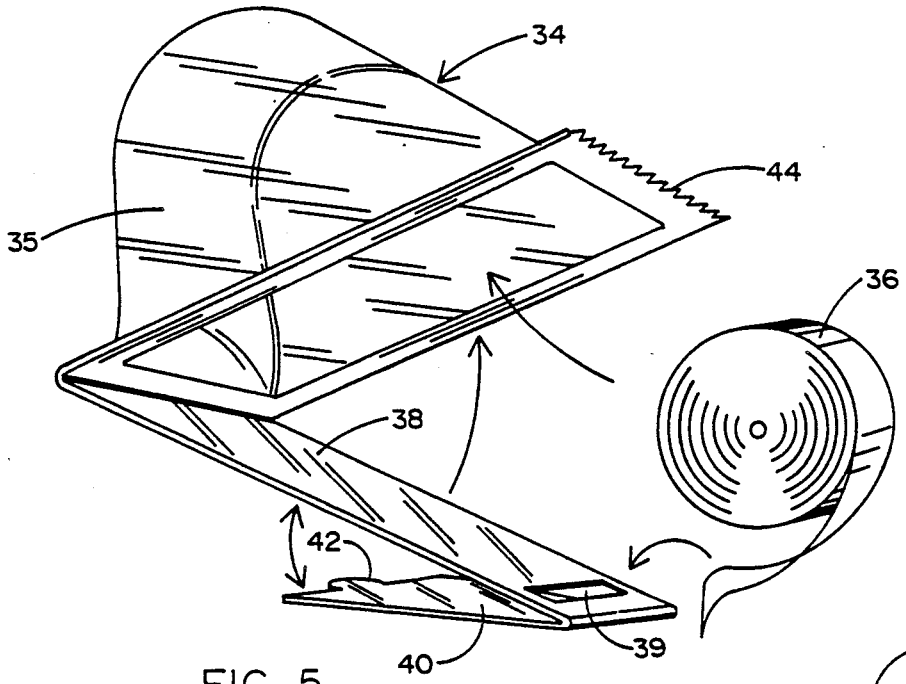
FIG. 5 shows a disposable, one-piece taping tool into which a roll of pre-coated drywall tape can be loaded and stored.
Figure 7:
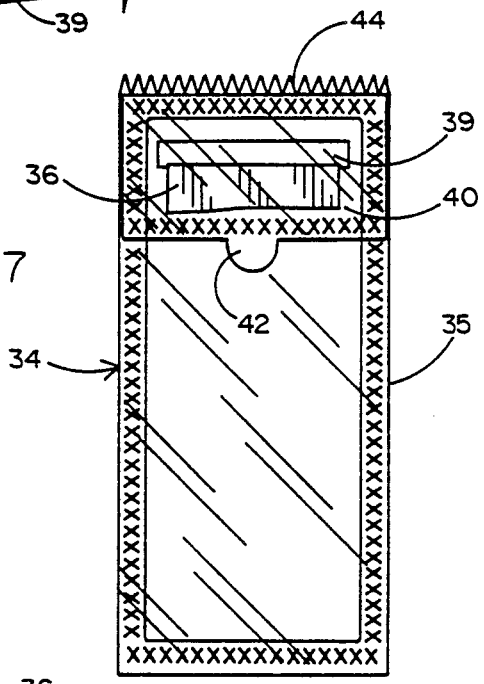
FIG. 7 is a bottom view of the disposable taping tool.
Figure 6:
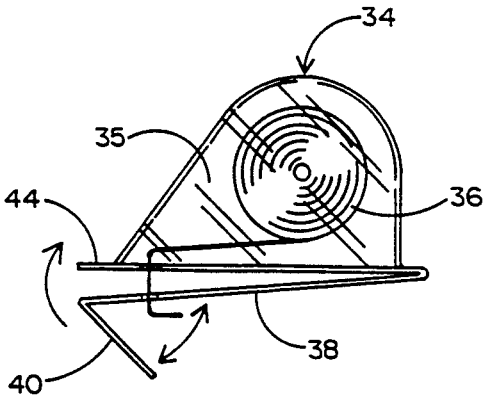
FIG. 6 is a side view of the disposable taping tool of FIG. 5.

FIGS. 5–7 of the drawings show a disposable, one-piece taping tool 34 having a hollow housing 35 in which a roll of pre-coated tape 36 may be packaged for future use. The housing 35 is preferably manufactured from a lightweight, vacuum molded plastic (e.g. styrene). Like the housing 16 of the reusable taping tool 10 of FIGS. 2–4, the housing 35 of the disposable taping tool 34 of FIGS. 5–7 has an arcuate shape within which a pre-coated roll of drywall tape 36 is received. However, the disposable taping tool 34 is loaded with a roll of pre-coated drywall tape 36 and sealed at the factory so as to be available for one use only. Therefore, it is not necessary that taping tool 34 be provided with a hand crank (like that designated 28 in FIG. 2), since the housing 35 will not be reloaded after its tape supply is exhausted. By including anti-bacterial additives within the housing 35 of a properly sealed disposable taping tool 34, a roll of pre-coated drywall tape 36 can to have a shelf life of approximately one year.

Disposable taping tool 34 has a flat baseplate 38 which is fixedly sealed across the housing 35 after the pre-coated roll of drywall tape is loaded in said housing at the factory. An exit opening 39 is formed in the baseplate 38 of tool 34 through which the leading end of the tape supply roll 36 is pulled before the baseplate is closed against the housing 35. Hingedly attached at one end thereof to the baseplate 38 is a bottom flap 40. Protruding from the other end of bottom flap 40 is a pull tab 42. With the baseplate 38 fixedly sealed across housing 35, the flap 40 is rotated towards and releasably sealed against said baseplate 38 (best shown in FIG. 7), such that the leading end of the drywall tape 36 which is removed from housing 35 through exit slot 39 is retained between plate 38 and flap 40 (best shown in FIG. 6).

When it is desirable to gain access to the supply of pre-coated tape within the housing 35 of disposable taping tool 34, the user pulls the pull tab 42 so as to break the seal between bottom flap 40 and baseplate 38. Flap 40 is then rotated away from and broken off the baseplate 38 to permit access to the leading end of the drywall tape 36 which is located therebetween. The pre-coated tape 36 stored within disposable taping tool 34 is applied to a seam between a pair of drywall panels int he same manner as the tape 2 from the reusable taping tool 10 of FIG. 2. Moreover, the trailing end of tool 34 is provided with serrated cutting edge 44 so that a suitable length of tape 36 may be easily cut off from the supply roll thereof. However, when the supply of tape is exhausted, the empty housing 35 is discarded, and a new package with a fresh roll of pre-coated drywall tape is opened and used in the manner just described.

FIGS. 8–12 of the drawings illustrate the details of the frame 1 and mud reservoir 4 which form the taping system shown in FIG. 1. More particularly, the frame 1 comprises a pair of vertically extending, parallel side bars 50. A pair of laterally extending, parallel support bars 52 are connected to respective side bars 50. The tops of side bars 50 are connected together to form a handle 54 by which t permit the frame 1 to be conveniently lowered into or removed from the mud reservoir 4 for the purpose of cleaning or reloading with a fresh roll of drywall tape 2. A supply hub 56 is releasably attached to frame 1 between side bars 50. In the assembled relationship, the supply hub 56 supports a roll of uncoated drywall tape 2 that is to be bathed in mud within the mud reservoir 4 and rolled up in the reusable taping tool 10 (best shown in FIG. 9).

A pair of parallel shafts 58 and 60 are also attached to frame 1 between side bars 50. Shaft 58 is located above shaft 60 to support a rotatable separation roller 62. Shaft 60 is located near the bottom of frame 1 to support a rotatable bottom roller 64. A pair of parallel mud control bars 66 are connected between the side bars 50 below the supply hub 56 and above the separation roller 62. Mud control bars 66 are arranged in parallel alignment with supply hub 56 and shafts 58 and 60 to facilitate the threading of the drywall tape 2 around frame 1 in a manner that will soon be described. Mud control bars 66 are spaced closely together so that a small gap 68 is formed therebetween, whereby the thickness of the mud with which the drywall tape 2 is coated can be controlled, as will also soon be described.

The frame 1 is threaded with drywall tape 2 by feeding the leading end of the uncoated roll thereof downwardly along side bars 50 and around bottom roller 64. The leading end is then pulled over separation roller 62 and through the gap 68 between mud control bars 66. That portion of the tape 2 that is covered with mud from reservoir 4 may now be connected to and rolled up within the taping tool 10 in the manner previously described while referring to FIGS. 2–4 and illustrated in FIG. 9.

As earlier described, the mud reservoir 4 includes a conventional pair 6 and a vertical extension of collar 8. The pail 6 may be a five gallon plastic bucket in which drywall mud is commonly sold. The collar 8 is cylindrically shaped with an open ended top and a diaphragm 70 extending across the bottom thereof. The diameter of cylindrical collar 8 is suitably sized so that collar 8 may be detachably snap fit to the pail 6 around the rim thereof (best shown in FIG. 9). A mud filling hole 71 is formed in the diaphragm 70 of collar 8 to permit the pail 6 to be refilled with an additional supply of mud. An opening 72 is also formed in the diaphragm 70 and dimensioned to receive therethrough a portion of the frame 1, such that the bottom roller 64 is disposed within the mud supply 74 of pail 6 (also best shown in FIG. 9).

Figure 9:
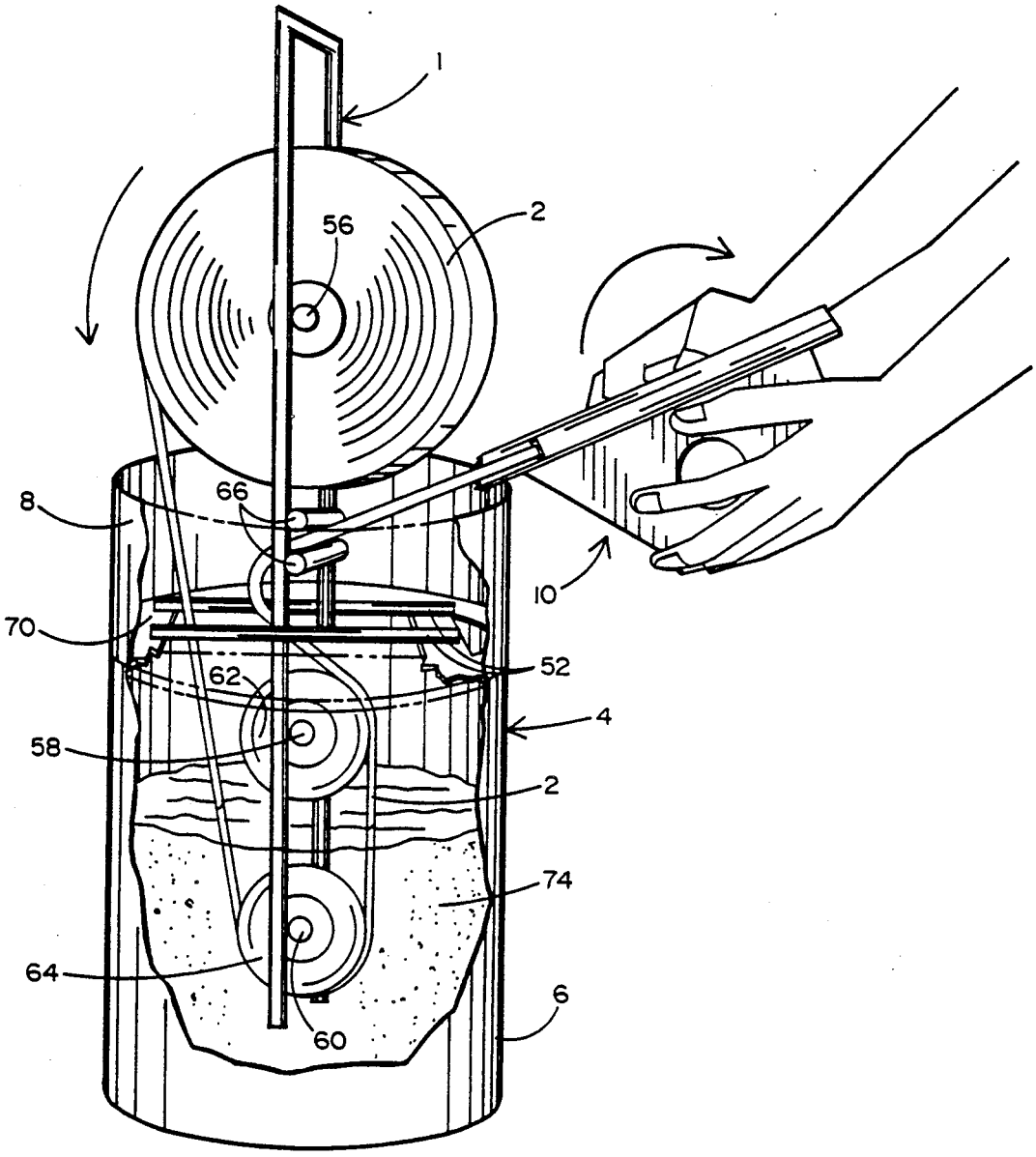
FIG. 9 shows the taping system of FIG. 8 in the assembled relationship.
Figure 10:
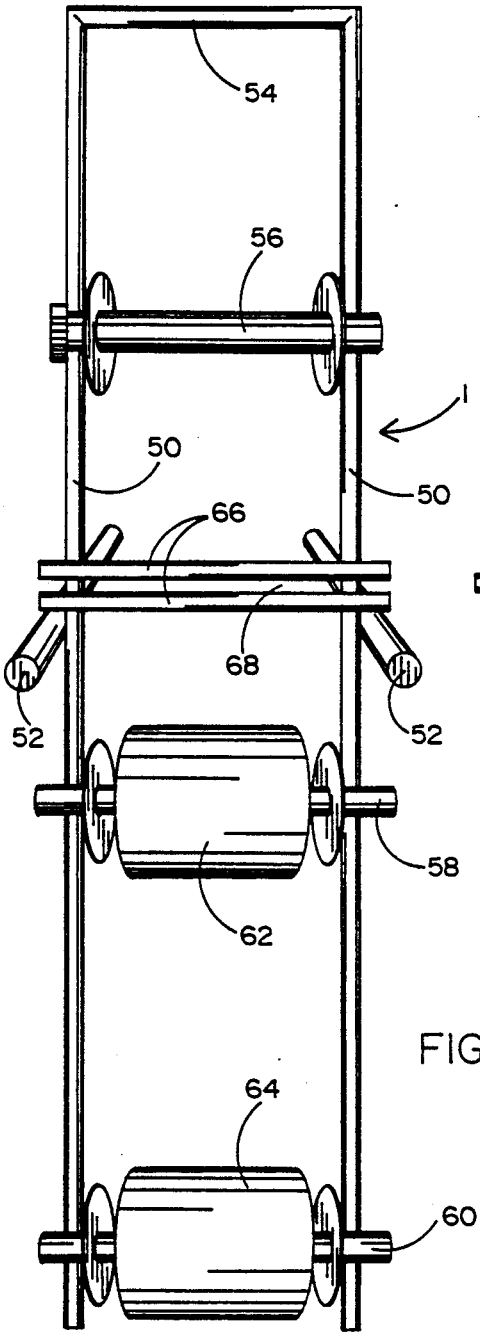
FIG. 10 is a front view of the frame which forms the taping system of FIGS. 8 and 9.
Figure 11:
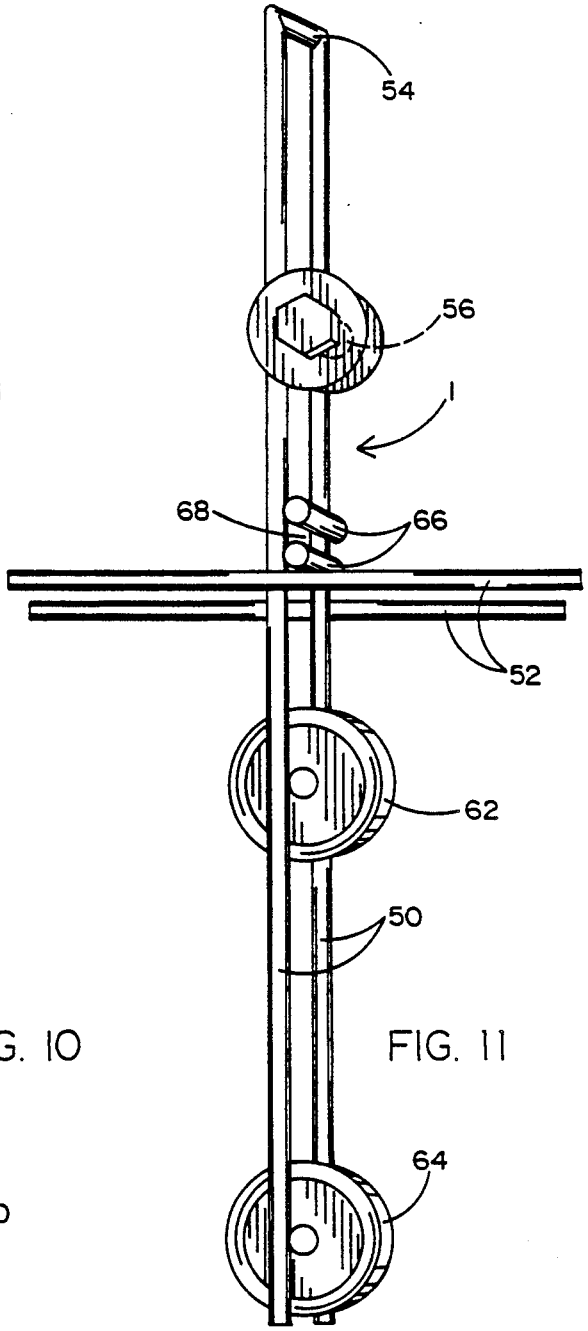
FIG. 11 is a side view of the frame.
Figure 12:
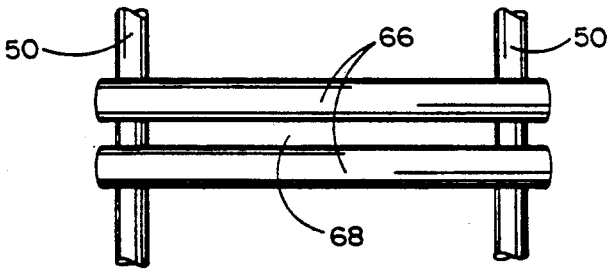
FIG. 12 is an enlarged detail of the mud control bars of the frame.

That is, and referring to the assembled configuration of FIG. 9, the pail 6 of mud reservoir 4 is filled with a bath of wet adhesive mud 74, and the frame 1 around which the drywall tape 2 is threaded is lowered through the opening 72 in diaphragm 70 until the laterally extending support bars 52 are engaged by said diaphragm. With the support bars 52 of frame 1 resting upon diaphragm 70, the roll of uncoated drywall tape 2 is suspended at supply hub 56 above collar 8, while the bottom roll 64, around which the tape 2 is threaded, will be totally immersed within the mud bath 74 of pail 6. Inasmuch as the path of the drywall tape 2 extends around bottom roller 64 and through the mud bath 74, both sides of the tape will be simultaneously coated with mud. Moreover, by passing the mudded tape 2 between mud control bars 66, excess mud will be wiped off so that the tape which exits frame 1 will have a uniform coating of mud on both sides thereof.

The taping tool 10 is then turned upside down, and, as previously disclosed, the leading end of the drywall tape 2 is connected to and wound up within said tool 10 when the user turns the hand crank thereof. Accordingly, and by virtue of the present invention, a pre-coated supply of drywall tape may be conveniently stored and easily handled in taping tool 10 so as to be dispensed therefrom and applied to the seam between drywall panels in the manner described when referring to FIG. 2.

FIGS. 13–15 of the drawings show a taping shoe 76 to which the taping tool 10 can be removably attached, such that the pre-coated tape that is dispensed from tool 10 can be applied to inside corners. The taping shoe 76 includes a flat baseplate 78 and a pair of side walls that are connected together at an angle at first ends thereof and interconnected with baseplate 78 and their opposite ends. Extending outwardly from and slightly above the sides of baseplate 78 are respective guide rails 82. Guide rails 82 are dimensioned to releasably engage the baseplate 22 of taping tool 10 so that taping shoe 76 and taping tool 10 can be attached to one another as the baseplate 22 of tool 10 slides along the baseplate 78 and under the guide rails 82 of shoe 76 (in the direction of the reference arrow).An exit opening 84 is formed in the baseplate 78 and side walls 80 of taping shoe 76 through which to dispense the pre-coated drywall tape 2 that is played out of taping tool 10. That is to say, and as is best shown by the assembled configuration of FIG. 14, as the combination taping tool 10 and taping shoe 76 slide (in the direction of the reference arrow) along the inside corners (not shown) of an area to be taped, the drywall tape 86 that is dispensed from the tool 10 and shoe 76 will be automatically folded in half by and along the bottom of angled side walls 80. More particularly the drywall tape 86 is folded, smoothed out, and embedded in mud as the angled sidewalls 80 of shoe 76 ride over the tape and along the inside corners to be taped.

The advantages of the disclosed taping system are numerous. The pre-coated drywall tape is applied and embedded in operation, thereby resulting in a minimal number of air blisters developing under the tape. The fact that the drywall tape is pre-coated and softened prior to application produces a better tape joint than that possible with conventional taping systems. The presently disclosed system is easy to operate and is relatively fast, precise and convenient when compared with prior art taping systems. Moreover, the disclosed taping system may be used without acquiring any special training. The absence of complex mechanical apparatus will greatly reduce the possibility of breakdown and the need for repair. What is more, the relatively small size and lightweight characteristics of the taping system makes such system better suited for transport and storage, while reducing the costs of manufacture.

It will be apparent that while a preferred embodiment of the invention has been shown and described, various modifications and changes could be made without departing from the true spirit and scope of the invention.

Having thus set forth a preferred embodiment of the invention, what is claimed is:

1. A system for coating drywall tape with adhesive mud, said system comprising, in combination:

a reservoir having a top and a bottom for receiving a supply of mud;

a frame connected to said reservoir at the top thereof, said frame having means by which to suspend a roll of uncoated drywall tape above the mud supply of said reservoir and tape positioning means disposed below said tape suspending means to be located within the mud supply of said reservoir, such that drywall tape which is unwound from the roll and threaded around said tape positioning means will be immersed in ad simultaneously coated on both sides thereof with the mud of said reservoir; and tape storage and dispensing means having a housing for storing mud coated tape, an opening in said housing through which mud coated tape can be dispensed, and means attached to said housing for reeling said mud coated tape out of said reservoir and into said housing by way of said opening.

2. The system recited in claim 1, wherein said reservoir includes a closure extending across the top thereof, said closure having an opening formed therein for receiving at least some of said frame therethrough, such that said tape positioning means is disposed within the mud of said reservoir.

3. The system recited in claim 2, wherein said frame includes at least one horizontal extending support bar to rest upon said closure to provide support for said frame.

4. The system recited in claim 2, further comprising a collar connected to the top of said reservoir to form a vertical extension thereof, said collar containing the closure which extends across the top of said reservoir.

5. The system recited in claim 4, wherein said reservoir is a cylindrical bucket and said collar is a cylindrical extension of said bucket, said collar being detachably connected to said bucket at the rim thereof.

6. The system recited in claim 1, wherein said frame includes a pair of closely spaced mud control bars between which the drywall tape is threaded after such tape is first threaded around said tape positioning means and coated with mud, said mud control bars wiping excess mud from the tape which passes therebetween.

7. The system recited in claim 1, wherein said tape storage and dispensing means includes a flap which is removably sealed across the opening formed in said housing.

8. The system recited in claim 1, wherein said tape storage and dispensing means also has a shaft located at the interior of said housing around which the mud coated drywall tape from said reservoir is to be wound and a hand crank located at the outside of said housing for rotating said shaft and causing the mud coated tape to be drawn inwardly of said housing through said opening and wound around said shaft.

9. The system recited in claim 8, wherein said shaft has a hook projecting therefrom, said hook being attached to the leading end of the mud coated tape that is removed from said reservoir to be wound around said shaft and stored within said housing.

10. The system recited in claim 1, further comprising a taping shoe to be removably attached to the housing of said tape storage and dispensing means having an exit opening through which can be pulled the mud coated tape that is dispensed through the opening formed in said housing, said taping shoe having a pair of angled side walls that are adapted to ride over and fold the mud coated tape being pulled out through said exit opening.

11. A system for coating drywall tape with adhesive mud and for handling the mud coated tape, said system comprising, in combination:

a reservoir in which to receive a bath of mud;

a frame interconnected with said reservoir and communicating with the mud bath thereof, said frame having means to suspend a roll of uncoated drywall tape above the mud bath of said reservoir and providing a tape path through said mud bath, such that drywall tape is unwound from its roll to be immersed in and coated with the mud of said bath; and means for removing the mud coated tape from said reservoir, said removing means having a housing in which the mud coated tape is stored for later use, a shaft located at the interior of said housing around which the mud coated tape is wound, an opening in said housing through which the mud coated tape is pulled in and played out, and a hand crank located at the outside of said housing for rotating said shaft and causing the mud coated tape to be drawn inwardly of said housing through said opening therein so as to be wound around said shaft.

12. The system recited in claim 11, further comprising a taping shoe to be detachably connected to the housing of said tape removing means and having an exit opening through which is dispensed the mud coated tape that is played out from said housing via the opening therein, said taping shoe having a pair of angled side walls that are adapted to ride over and fold the mud coated tape being dispensed through said exit opening.

* * * * *